US007406410B2

(12) United States Patent
Kikuiri et al.

(10) Patent No.: US 7,406,410 B2
(45) Date of Patent: Jul. 29, 2008

(54) ENCODING AND DECODING METHOD AND APPARATUS USING RISING-TRANSITION DETECTION AND NOTIFICATION

(75) Inventors: Kei Kikuiri, Yokosuka (JP); Nobuhiko Naka, Yokohama (JP); Tomoyuki Ohya, Yokosuka (JP)

(73) Assignee: NTT DoCoMo, Inc., Tokyo (JP)

( * ) Notice: Subject to any disclaimer, the term of this patent is extended or adjusted under 35 U.S.C. 154(b) by 891 days.

(21) Appl. No.: 10/359,638

(22) Filed: Feb. 7, 2003

(65) Prior Publication Data

US 2003/0154074 A1 Aug. 14, 2003

(30) Foreign Application Priority Data

Feb. 8, 2002 (JP) ..... 2002-033154

(51) Int. Cl.
*G10L 19/12* (2006.01)

(52) U.S. Cl. ..... 704/221; 704/222

(58) Field of Classification Search ..... 704/221, 704/222

See application file for complete search history.

(56) References Cited

U.S. PATENT DOCUMENTS 5,717,825 A * 2/1998 Lamblin ..... 704/223
6,311,154 B1 * 10/2001 Gersho et al. ..... 704/219
6,496,794 B1 * 12/2002 Kleider et al. ..... 704/201
6,691,082 B1 * 2/2004 Aguilar et al. ..... 704/219

FOREIGN PATENT DOCUMENTS

| | | |
|---|---|---|
| JP | 8-237132 | 9/1996 |
| JP | 8-263096 | 10/1996 |
| JP | 10-107641 | 4/1998 |
| JP | 2000-259197 | 9/2000 |

OTHER PUBLICATIONS

International Standard ISO/IEC 14496-3, Second Edition, The Whole Book, "Information Technology—Coding of Audio-Visual Objects", Dec. 15, 2001.

Sean A. Ramprashad, "A Two Stage Hybrid Embedded Speech/Audio Coding Structure", Acoustics, speech and signal processing, XP-010279163, May 12, 1998, pp. 337-340.

* cited by examiner

*Primary Examiner*—Michael Opsasnick
(74) *Attorney, Agent, or Firm*—Oblon, Spivak, McClelland, Maier & Neustadt, P.C.

(57) ABSTRACT

A decoding apparatus is provided. The decoding apparatus has a first decoding part for decoding a code word obtained by encoding an input signal using a Code-Excited Linear Prediction encoding method. A second decoding part decodes a code word obtained by encoding a signal with an encoding method other than the Code-Excited Linear Prediction encoding method. A rising-transition detection and notification part has a detection part that detects the existence of a rising-transition of amplitude of the input signal based on time variation of a gain of excitation vectors obtained by the first decoding part, and a notification part that notifies the second decoding part that the rising-transition of the amplitude exists.

47 Claims, 16 Drawing Sheets

ENCODING AND DECODING METHOD AND APPARATUS USING RISING-TRANSITION DETECTION AND NOTIFICATION

BACKGROUND OF THE INVENTION

1. Field of the Invention

The present invention relates to a decoding apparatus, an encoding apparatus, a decoding method and an encoding method. More particularly, the present invention relates to a decoding apparatus, and an encoding apparatus in which an input signal is compressed highly-efficiently and encoded or decoded, and a decoding method and an encoding method in which the input signal is compressed highly-efficiently and encoded or decoded.

2. Description of the Related Art

Presently, there are various kinds of encoding and decoding apparatuses and methods that highly-efficiently compress speech and acoustic signals. One of such encoding and decoding methods is a scalable encoding method in which a part of an encoded sequence can be decoded according to a required quality or status of a network because it has scalable encoding characteristics. The scalable encoding process has an architecture to successively encode an input signal in such a way that an error signal between the input signal and a decoded signal of a lower layer encoder is further encoded by a higher layer encoder. The lowest layer is called a core layer and higher layers than the lowest layer are called enhancement layers. An example of a representative scalable encoding method is described in ISO/IEC14496-3, which is called MPEG-4 Audio, standardized by ISO/IEC. FIG. 1 shows a block diagram of the scalable encoding process. In FIG. 1, the Code-Excited Linear Prediction (CELP) encoding method, a parametric encoding method, such as for example, the Harmonic Vector Excitation Coding (HVXC) method and the Harmonic Individual Line with Noise (HILN) method or, a transform coding method, such as, for example, the Advanced Audio Coding (AAC) method and the Transform Domain Weighted Interleave Vector Quantization (TwinVQ) method is used in a core layer encoder 101. The encoders that perform the transform coding method are used in enhancement layer encoders 104.

FIG. 2 shows a block diagram of a CELP encoder. The CELP encoder as shown in FIG. 2 mainly has a linear prediction analyzer 201, a linear prediction coefficient quantization part 202, a linear prediction synthesis filter 203, an adaptive code book 204, a fixed code book 206, a perceptual weighting filter 208, a controller 209, an adder 212 and a subtracter 213. An input signal 200 is supplied to the CELP encoder every 5 to 40 ms and linear prediction analysis is performed on the input signal by the linear prediction analyzer 201. Then, the linear prediction coefficients 210 obtained by the linear prediction analysis are quantized by the linear prediction coefficient quantization part 202. The linear prediction synthesis filter 203 is constructed using the quantized linear prediction coefficients obtained as described above. Excitation vectors 211 to drive the linear prediction synthesis filter 203 are stored in the adaptive code book 204. The adaptive code book excitation vector is output from the adaptive code book 204 and the fixed code book excitation vector is output from the fixed code book 206 according to an output signal from the controller 209. Each of the vectors is multiplied by an adaptive code book gain 205 or a fixed code book gain 207, respectively. Then, the excitation vector 211 is generated at an output of an adder 212 by means of adding the results multiplied by each of the gains. The excitation vector 211 generated as described above is supplied to the linear prediction synthesis filter 203. An output signal of the linear prediction synthesis filter 203 is a synthesis signal, and an error signal between the input signal and the synthesis signal is calculated by the subtracter 213 and then, the error signal is supplied to the perceptual weighting filter 208. The perceptual weighting filter 208 supplies the perceptually weighted error signal to the controller 209. The controller 209 searches the excitation vector 211 so that the power level of the perceptually weighted error signal has minimum value and then, determines the adaptive code book gain 205 and the fixed code book gain 207 using the selected adaptive code book excitation vector and the selected fixed code book excitation vector, respectively, by the searches so that the power level of the perceptually weighted error signal has minimum value.

FIG. 3 shows a block diagram of a CELP decoder 300. In the decoder 300 as shown in FIG. 3, the coefficients for a linear prediction synthesis filter 305, an adaptive code book 301, an adaptive code book gain 302, a fixed code book 303, and a fixed code book gain 304 are extracted from a code word sequence 311. The adaptive code book excitation vector and the fixed code book excitation vector are respectively multiplied by each of the gains and then, they are added by the adder 307 and then, the signal is an excited vector 306. The linear prediction synthesis filter 305 is driven by the excitation vector 306 and a decoded signal 312 is supplied as an output signal.

On the other hand, FIG. 4 shows an encoder 400 for transform coding. The encoder 400 mainly has an orthogonal transformation part 401, a transform coefficient quantization part 402 and a quantized transform coefficient encoding part 403. The transform coefficients 405 are calculated by performing the orthogonal transform for the input signal at the orthogonal transformation part 401. The transform coefficients 405 are quantized by the transform coefficient quantization part 402 and then, the quantized transform coefficients 406 are encoded to an encoded code sequence 407 by the quantized transform coefficient encoding part 403.

FIG. 5 shows a block diagram of a decoder 500 for decoding a transform-encoded code sequence 504. In the decoder as shown in FIG. 5, the encoded code sequence 504 is decoded to the quantized transform coefficients by the quantized transform coefficient decoding part 501 and then, the quantized transform coefficients are de-quantized to the transform coefficients by the transform coefficient de-quantization part 502. The transform coefficients obtained as described above are inverse-orthogonally-transformed to a decoded signal by the inverse orthogonal transformation part 503.

As described above, in the transform coding, the input signal in the time domain is orthogonally transformed into the coefficients in the frequency domain and then, the quantization and the encoding are performed. Therefore, when the encoded code sequence is inversely-transformed into the signal in the time domain, quantization noise that is generated by the quantization in the frequency domain spreads over a whole transform block (that is an unit of the transform coding) at approximately the same level. Therefore, if there is steep rising-transition of amplitude, which is so called 'attack', in a part of an input signal within the transform block, a pre-echo that is a jarring noise will occur at a part prior to the steep rising-transition of the amplitude. For example, if a transform block length is long, the interval in which the pre-echo occurs is also long. Therefore, the subjective quality is further degraded. When the transform coding is used in the scalable encoding as described above, the same problem as the problem generated by the transform coding arises.

To solve this problem, a technology of an adaptive block length conversion is used in the MPEG-4 Audio (ISO/IEC14496-3) as described above. In the technology, if there is a steep rising-transition of the amplitude in the input signal, a short transform block is used and, if there is not a steep rising-transition of the amplitude in the input signal, a long transform block is used. However, it is necessary to detect whether a steep rising-transition of the amplitude in the input signal exists or not in order to perform switching of the length. There is an example of such a detection method below. At first, the input signal is divided into the transform blocks and a Fourier transformation is performed on the transform blocks. Next, the obtained Fourier transform coefficients are divided to some frequency bands. Then, a parameter called perceptual entropy is calculated based on a signal to masking ratio (SMR) that is a ratio between the minimum audible noise calculated using a psychoacoustic model and the input signal power for each of the frequency bands. The steep rising-transition of the amplitude is detected by comparing the perceptual entropy with a predetermined threshold value. This method is used in the scalable encoding in the MPEG-4 Audio (ISO/IEC14496-3).

However, in the prior art method as described above, the length of the transform block is only adjusted to become short in order to shorten the interval in which the pre-echo exists. Further, because the transform block length varies, supplementary information that indicates the transform block length is required in order to decode the encoded code sequence at the decoding side. Therefore, the structure of the system becomes complex.

SUMMARY OF THE INVENTION

It is a general object of the present invention to provide a decoding apparatus, an encoding apparatus, a decoding method and an encoding method in which the above disadvantages are eliminated.

A more specific object of the present invention is to provide an apparatus and a method that detect the rising-transition of the amplitude of the input signal and notify encoding or decoding parts using another encoding method, in which, in an encoding and decoding apparatus or a method using the CELP encoding method and another encoding method, such as, for example, the scalable encoding method that uses the CELP encoding method as the core layer encoding method, it is possible to perform a process to cope with the pre-echo, which process is performed at a shorter time interval than the transform block used in the transform coding method, using the local decoded signal of the CELP encoded code sequence or the power of the decoded signal or the fixed code book gain that is a CELP encoding parameter.

The present invention uses the fact that the time variation of the power of the input signal, the time variation of the local decoded signal of the CELP encoded code sequence, and the time variation of the fixed code book gain of the CELP encoding are strongly correlated.

In the encoding and decoding apparatus or the method having the CELP encoding method and other encoding methods, such as, for example, the scalable encoding method that uses the CELP encoding method as the core layer encoding method, using the fact that the time variation of the power of the input signal, the time variation of the local decoded signal of the CELP encoded code sequence or the power of the decoded signal and the time variation of the fixed code book gain that is the CELP encoding parameter are strongly correlated, the present invention allows other encoding and decoding parts to perform a process that detects the rising-transition of the amplitude of the input signal, and provides a detected result to encoding or decoding parts of other encoding methods, and performs a process to cope with the pre-echo at a shorter time interval than the transform block used in the transform coding method, by means of observing the time variation of the local decoded signal or the power of the decoded signal or the fixed code book gain.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

In the following, embodiments of the present invention will be described with reference to figures. In the following description of the embodiments, a signal means a digital signal converted by an analog/digital converter.

First, a principle of rising-transition detection of the amplitude of the input signal will be explained.

Figure 1:
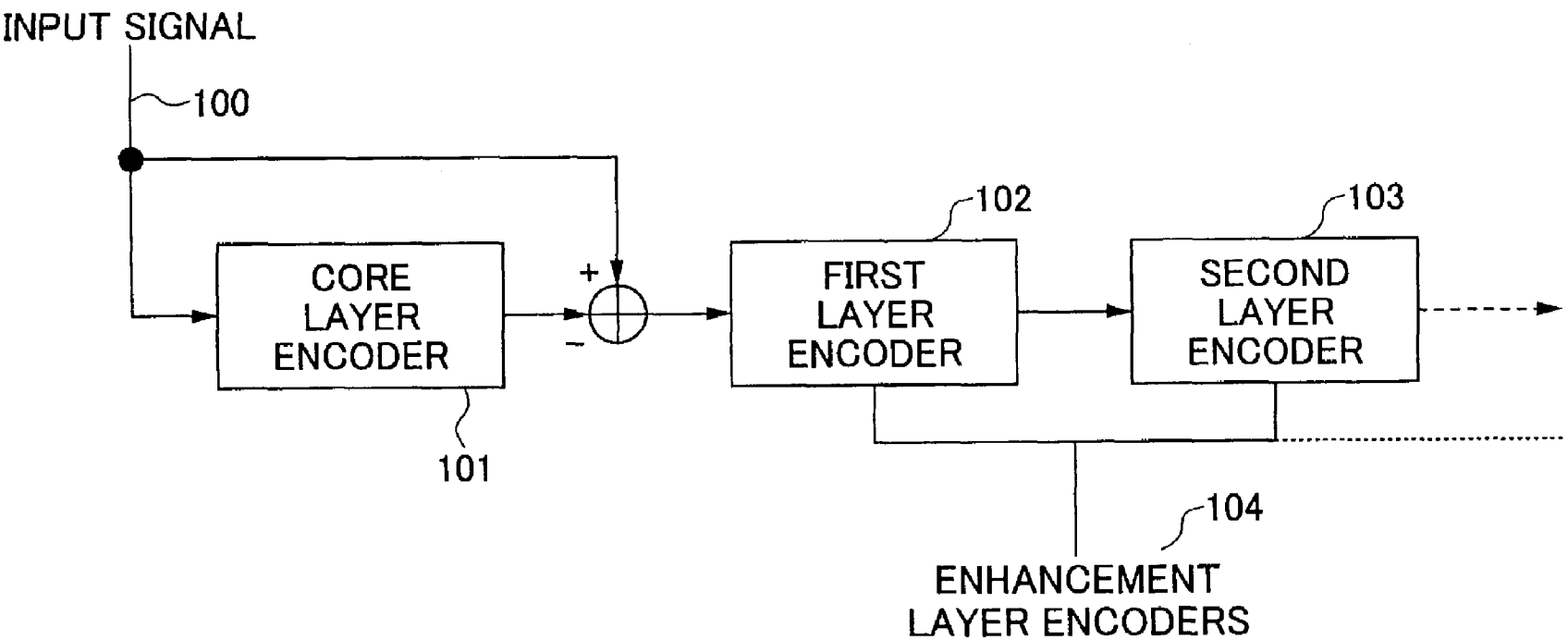
FIG. 1 shows a block diagram of a scalable encoding process.
Figure 2:
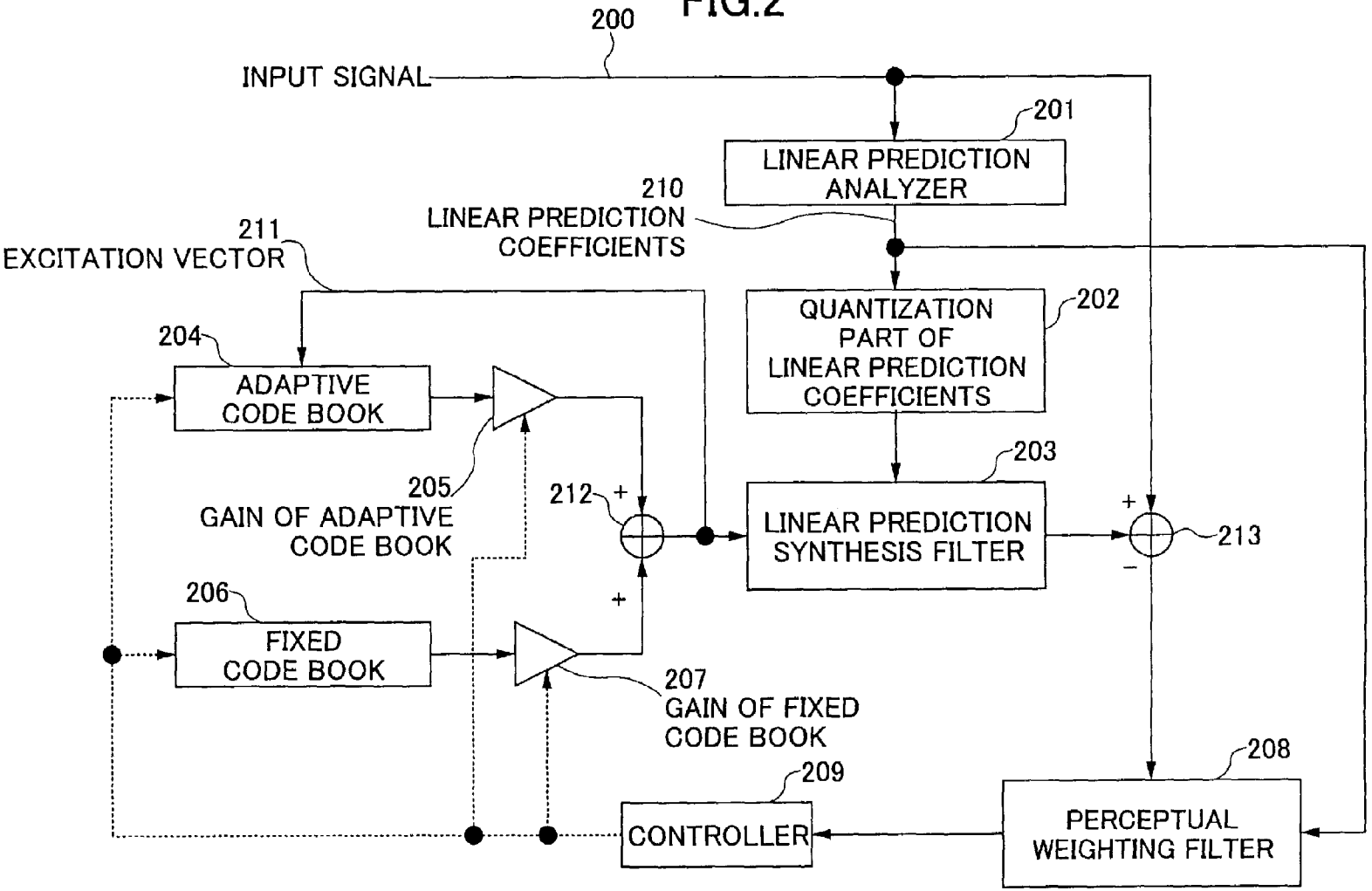
FIG. 2 shows a block diagram of a CELP encoder.
Figure 3:
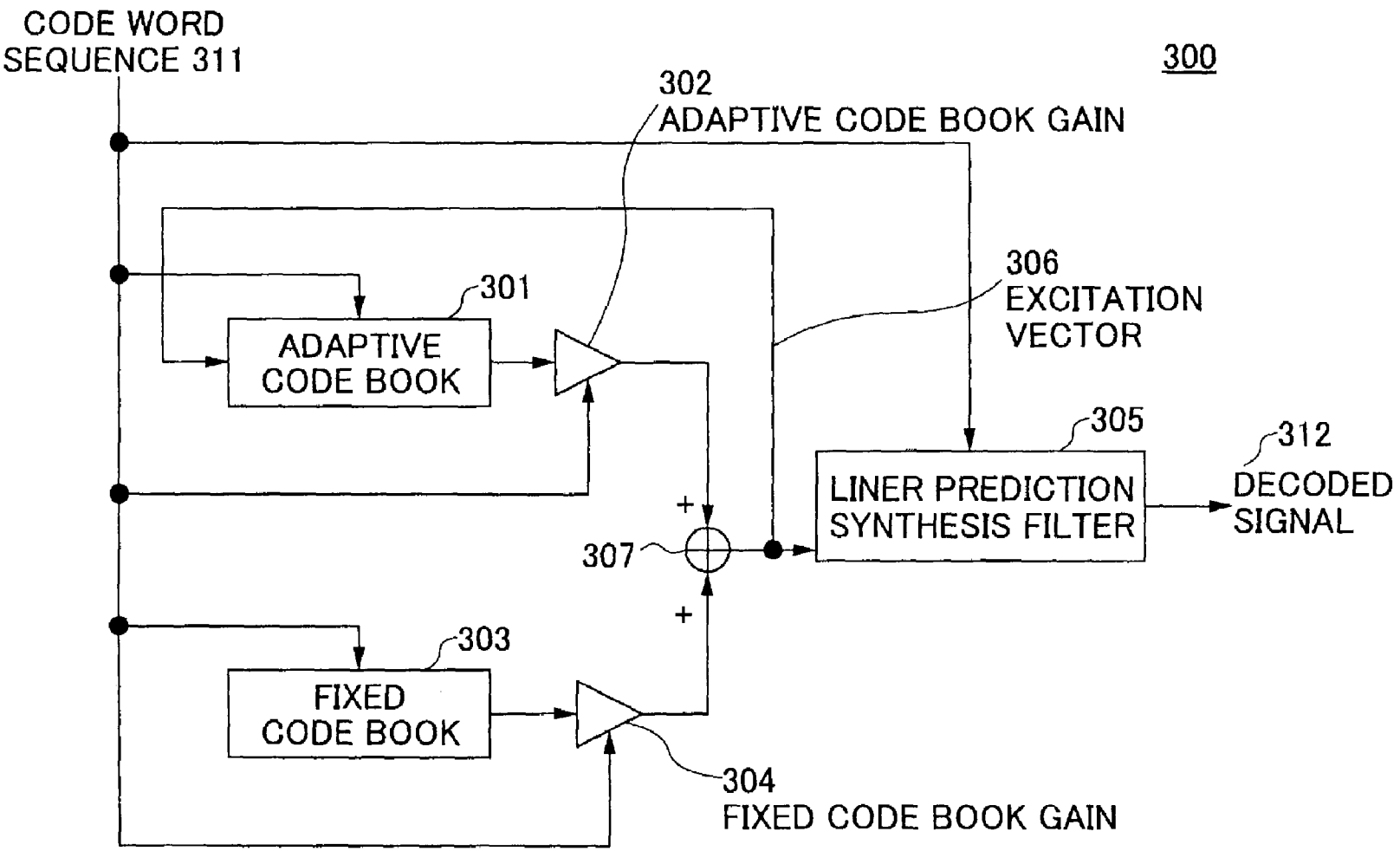
FIG. 3 shows a block diagram of a CELP decoder of the CELP encoding method.
Figure 4:
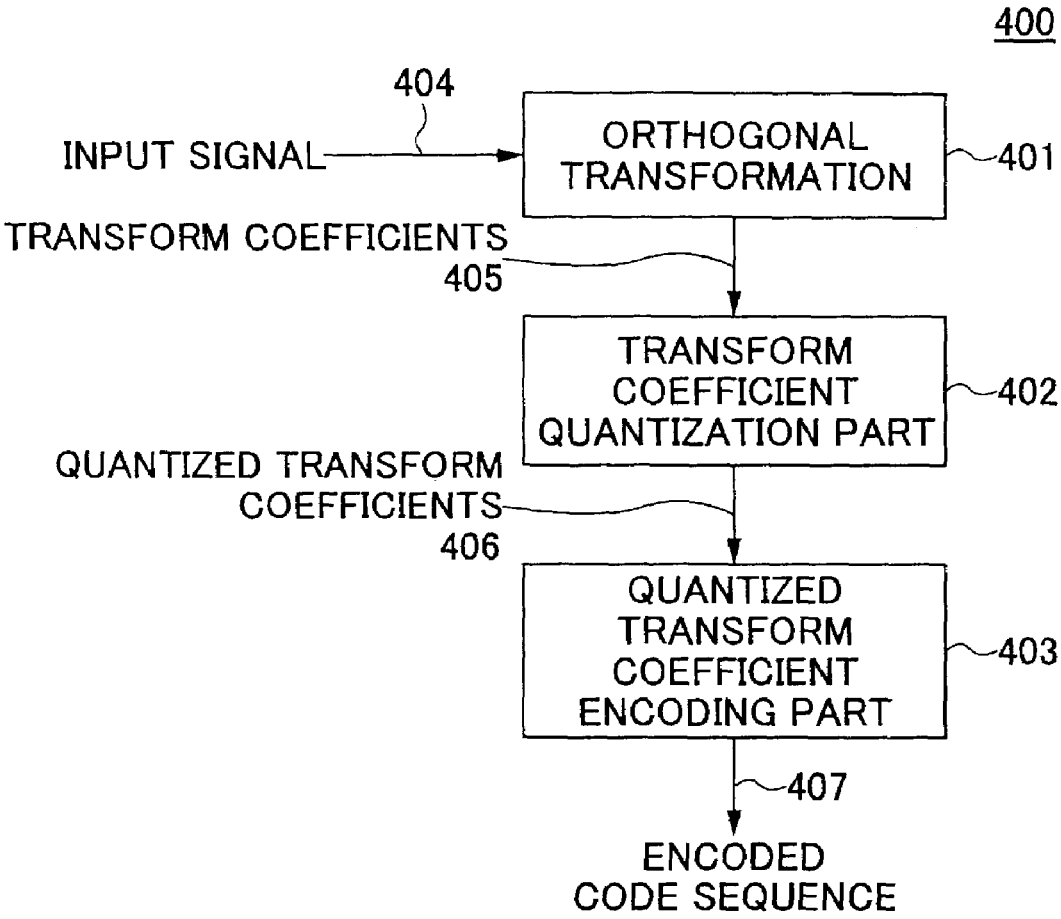
FIG. 4 shows an encoder for transform coding.
Figure 5:
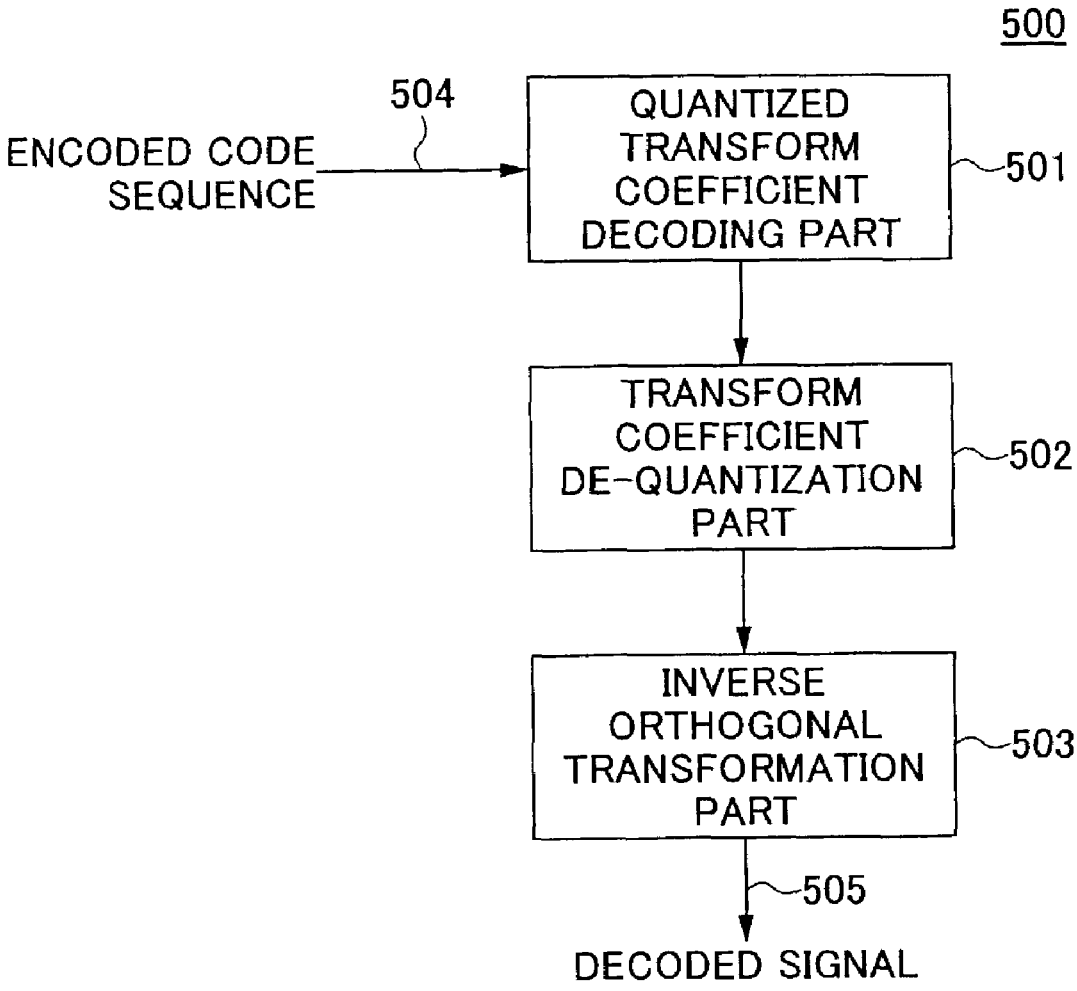
FIG. 5 shows a block diagram of a decoder of transform coding.
Figure 6:
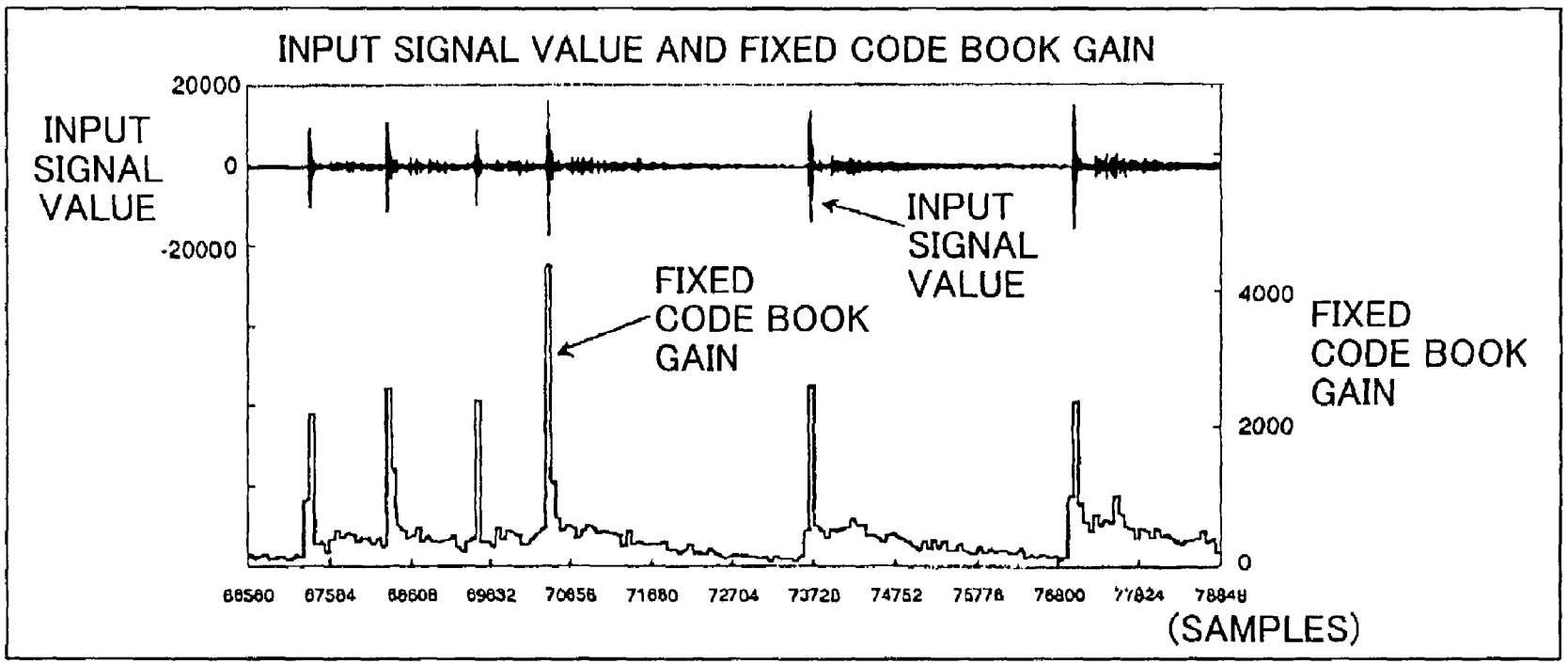
FIG. 6 shows a relationship between the time variation of the power of the input signal and the time variation of the fixed code book gain of the CELP encoding.

FIG. 6 shows a relationship between the time variation of the power of the input signal and the time variation of the fixed code book gain of the CELP encoding. The time variation of the power of the input signal and the time variation of the fixed code book gain of the CELP encoding are strongly correlated. Therefore, in the present invention, the fixed code book gain of the CELP encoding is observed and used to detect the rising-transition of the amplitude of the input signal.

Figure 7:
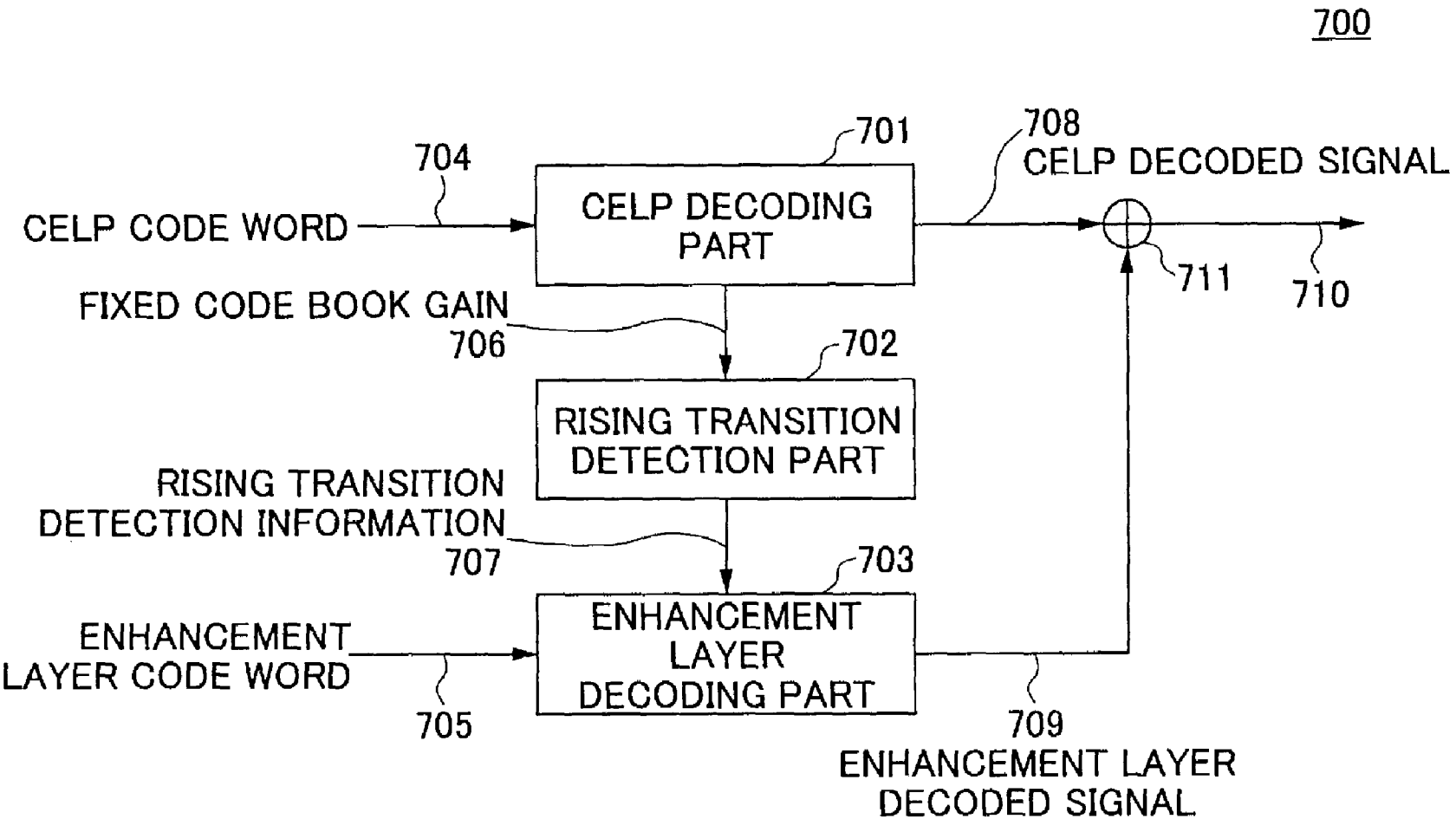
FIG. 7 shows a block diagram of a decoder according to the first embodiment of the present invention.

Next, the first embodiment of the present invention will be explained. FIG. 7 shows a block diagram of a decoder according to the first embodiment of the present invention, which decoder decodes an encoded code sequence encoded by means of the scalable encoding method in that the CELP encoding method is used as the core layer encoding method.

The decoder 700 has a CELP decoding part 701, a rising transition detection part 702, an enhancement layer decoding part 703 and an adder 711.

Figure 8:
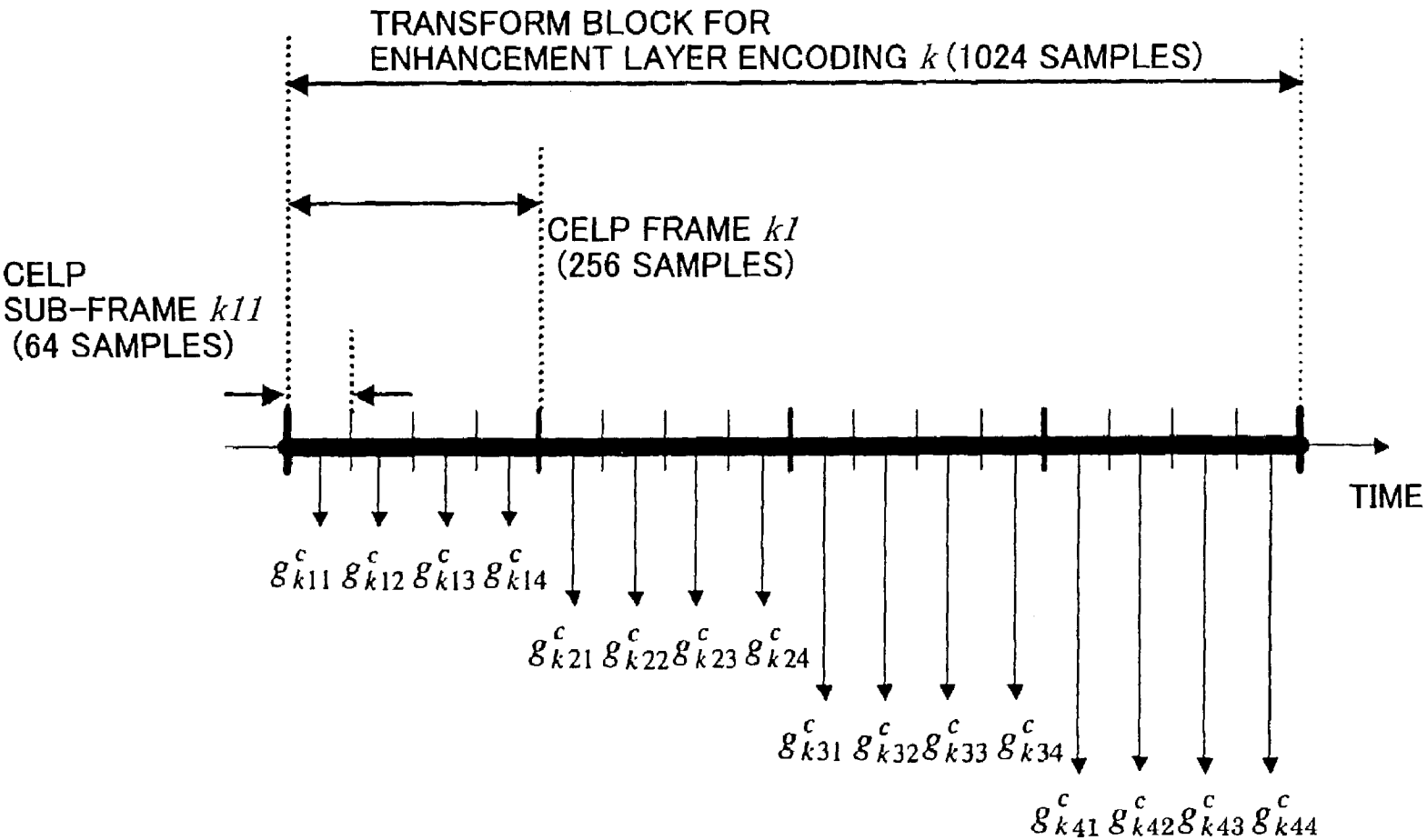
FIG. 8 shows a relationship between a frame and a subframe used for the CELP encoding and a transform block used for the transform coding.

FIG. 8 shows an example of a relationship between a frame and a sub-frame used in the CELP-encoding method that is used as the core layer and a transform block used for the transform coding method that is used as the enhancement layer. One transform block has four CELP frames and one CELP frame has four CELP sub-frames. One CELP sub-frame has 64 samples and one CELP frame has 256 samples, and one transform block has 1024 samples.

As shown in FIG. 7, the CELP decoding part 701 receives the CELP code words 704 encoded by means of the CELP encoding method and decodes the CELP code words 704 and supplies the CELP decoded signal 708 to the adder 711. At the same time, the CELP decoding part 701 supplies the fixed code book gain 706 to the rising transition detection part 702. The rising transition detection part 702 observes the time variation of the fixed code book gain 706 corresponding to a length of one transform block used for transform coding for the enhancement layer and detects rising-transition of the fixed code book gain 706 and outputs the rising transition detection information 707. The rising transition detection information 707 detected as described above is supplied to the enhancement layer decoding part 703.

On the other hand, the enhancement layer decoding part 703 receives the enhancement layer code words 705, and decodes the enhancement layer code words 705 according to the rising transition detection information 707 and then, supplies the enhancement layer decoded signal 709 to the adder 711. The adder 711 adds the CELP decoded signal 708 and the enhancement layer decoded signal 709 and outputs the decoded output signal 710.

For example, assuming that there is the relationship among the transform block, the CELP frame and the CELP sub-frame as shown in FIG. 8 The fixed code book gain is calculated for every CELP sub-frame during the CELP encoding process, and the fixed code book gains are encoded for every CELP frame. Therefore, in the enhancement layer decoding block 703, it is possible to observe the time variation of 16 fixed code book gains 706 for 16 CELP sub-frames in the transform block and to detect the rising-transition of the fixed code book gain. Therefore, because it is possible to detect the rising-transition of the fixed code book gain with a time precision of 1/16 of the transform block, it is possible to detect the rising-transition of the amplitude of the original signal with a time precision of 1/16 of the transform block.

Figure 9:
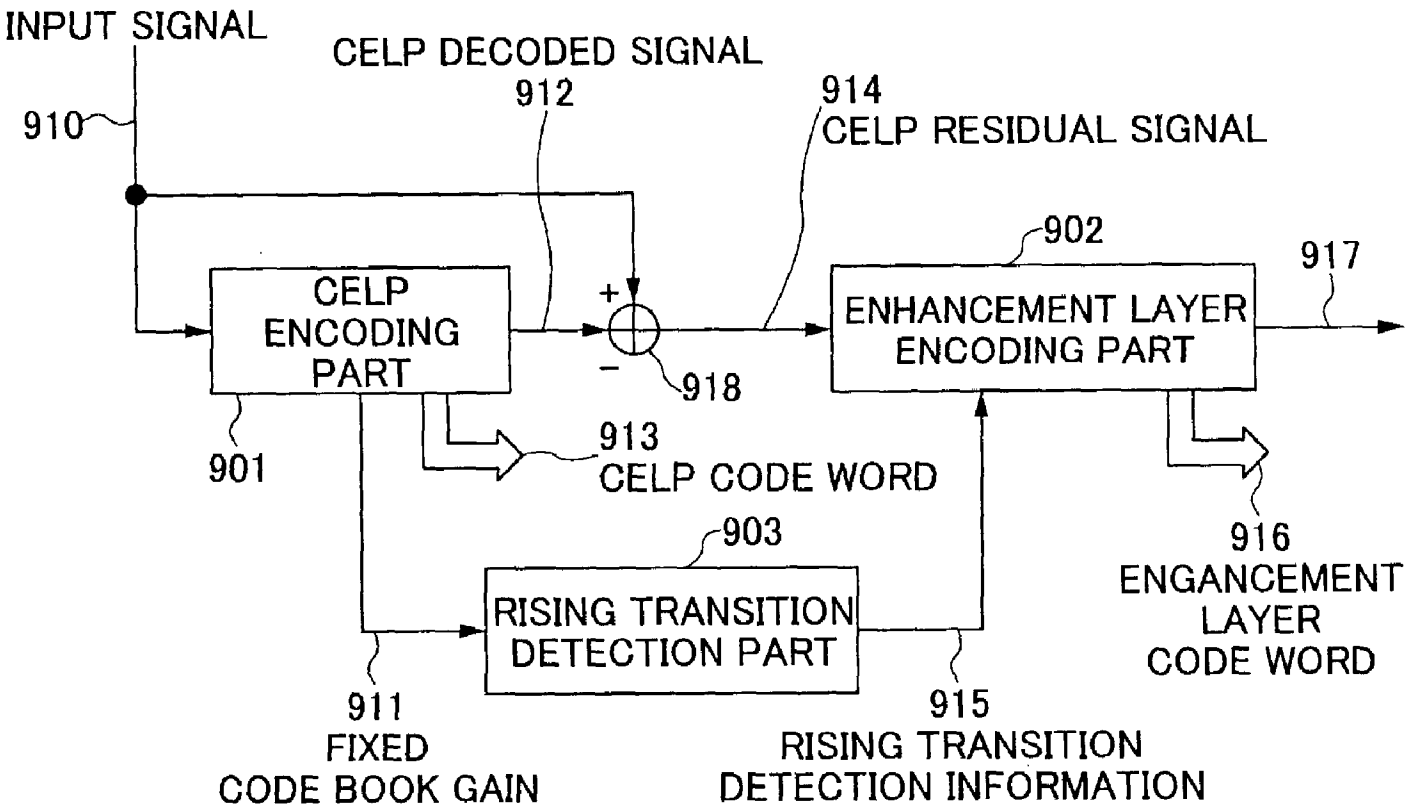
FIG. 9 shows a block diagram of an encoder according to the second embodiment of the present invention.

Next, the second embodiment of the present invention will be explained. FIG. 9 shows a block diagram of an encoder 900 according to the second embodiment of the present invention, which encodes an input signal by means of the scalable encoding method in that the CELP encoding method is used as the core layer encoding method. The encoder 900 has a CELP encoding part 901, an enhancement layer encoding part 902, a rising transition detection part 903 and a subtracter 918.

The input signal 910 is supplied to the CELP encoding part 901 and is encoded. The CELP code words 913 are output from the CELP encoding part 901, and at the same time, the fixed code book gain 911 is supplied to the rising transition detection part 903. Further, during the encoding process, the CELP decoded signal 912 that is a local decoded signal of the CELP encoded signal is also output from the CELP encoding part 901. In the subtracter 918, the CELP residual signal 914 that is the difference between the input signal 910 and the locally decoded CELP signal 912 is calculated, and the CELP residual signal 914 is supplied to the enhancement layer encoding part 902.

On the other hand, the same as described in the first embodiment, the rising transition detection part 903 observes the time variation of the fixed code book gain 911 and detects rising-transition of the fixed code book gain 911 and outputs the rising transition detection information 915. The rising transition detection information 915 is supplied to the enhancement layer encoding part 902 and the enhancement layer encoding part 902 refers to the rising transition detection information 915 to perform encoding of the enhancement layer.

Figure 10:
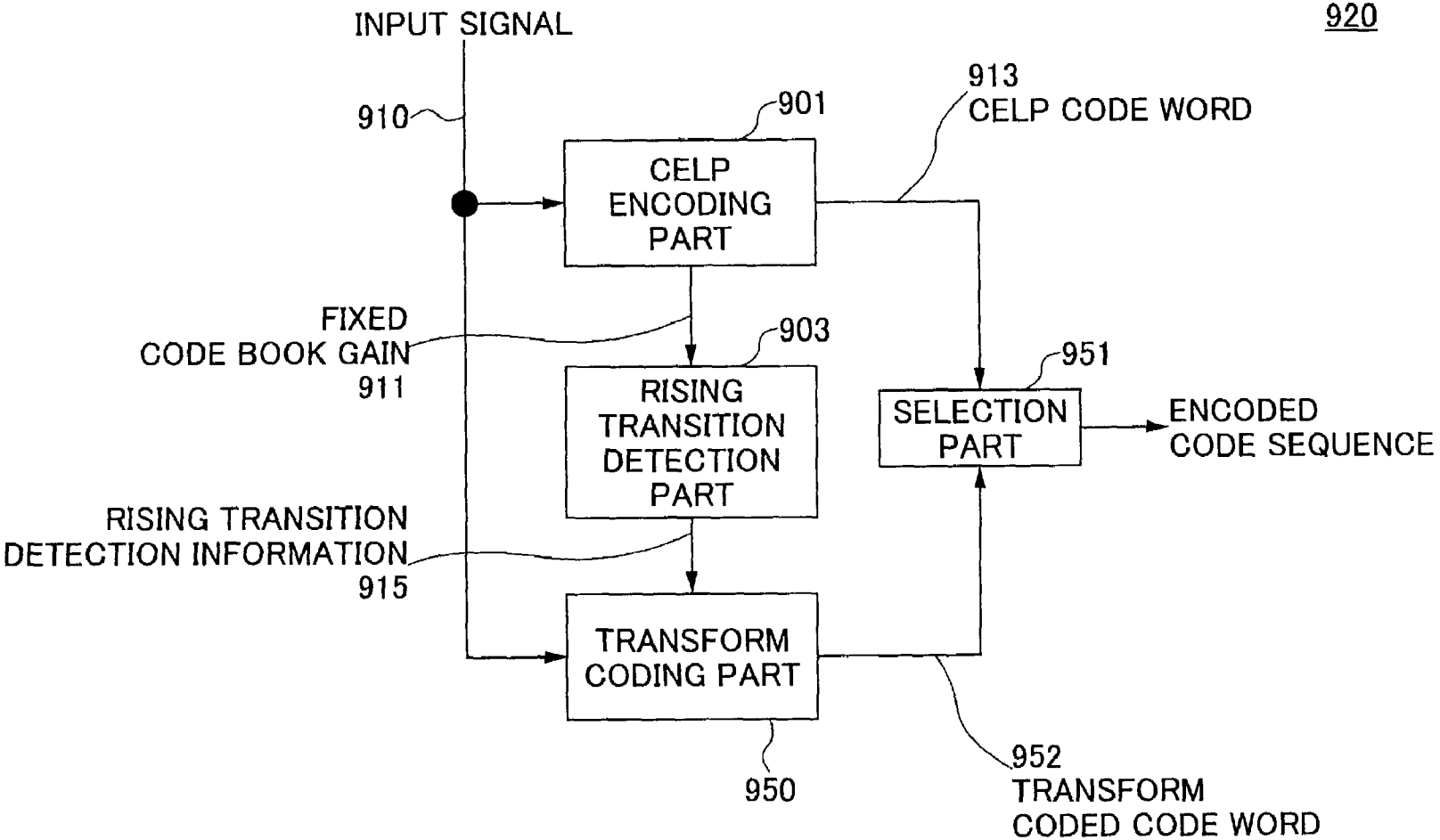
FIG. 10 shows a block diagram of an encoder according to the third embodiment of the present invention.

Next, the third embodiment of the present invention will be explained. FIG. 10 shows a block diagram of an encoder 920 according to the third embodiment of the present invention, in which the input signal is encoded using the CELP encoding method and another encoding method, such as, for example, the transform coding method, and either a code sequence encoded using the CELP encoding method or a code sequence encoded using the other encoding method is supplied as an output of the encoder.

The encoder 920 has the CELP encoding part 901, the rising transition detection part 903, a transform coding part 950 and a selection part 951.

In FIG. 10, the input signal 910 is encoded by the CELP encoding part 901 and the CELP code words 913 are output and at the same time, the fixed code book gain 911 is supplied to the rising transition detection part 903. On the other hand, the input signal 910 is also encoded by the transform coding part 950 and the transform coded code words 952 are output. At the same time, the same as described in the first embodiment, the rising transition detection part 903 observes the time variation of the fixed code book gain 911 and detects the rising-transition of the fixed code book gain 911 and outputs the rising transition detection information 915 to the transform coding part 950. The rising transition detection information 915 is supplied to the transform coding part 950 and the transform coding part 950 refers to the rising transition detection information 915 to perform encoding of the input signal 910.

Figure 11:
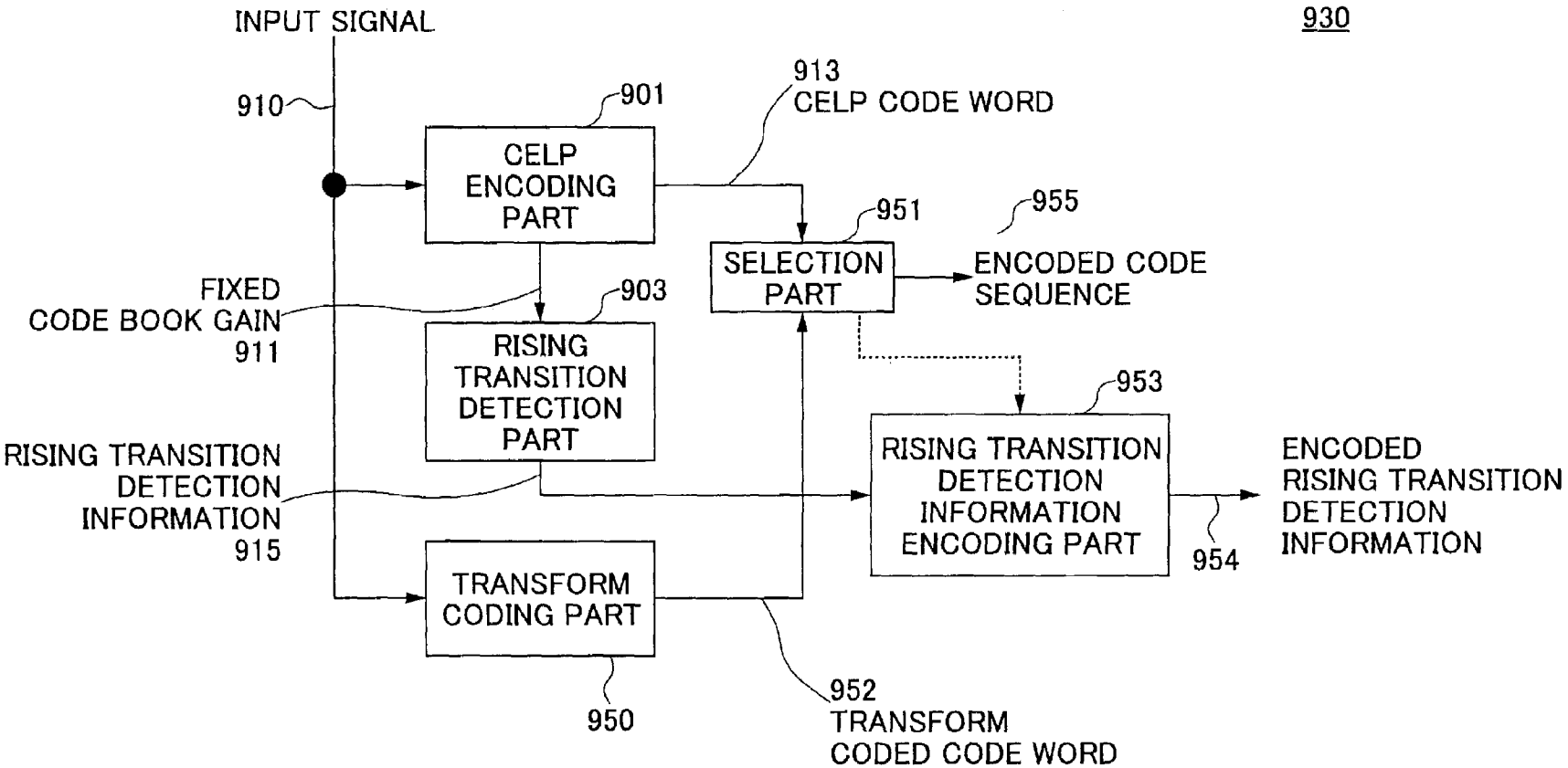
FIG. 11 shows a block diagram of an encoder according to the fourth embodiment of the present invention.

Next, the fourth embodiment of the present invention will be explained. FIG. 11 shows a block diagram of an encoder 930 according to the fourth embodiment of the present invention, in which the input signal is encoded using the CELP encoding method and another encoding method, such as, for example, the transform coding method, and either a code sequence encoded using the CELP encoding method or a code sequence encoded using the other encoding method is supplied as an output of the encoder.

The encoder 930 has the CELP encoding part 901, the rising transition detection part 903, a transform coding part 950, a selection part 951 and a rising-transition detection information encoding part 953.

In FIG. 11, the input signal 910 is encoded by the CELP encoding part 901 and the CELP code words 913 are output and at the same time, the fixed code book gain 911 is supplied to the rising transition detection part 903. On the other hand, the input signal 910 is also encoded by the transform coding part 950 and the transform coded code words 952 are output.

At the same time, the same as described in the first embodiment, the rising transition detection part 903 observes the time variation of the fixed code book gain 911 and detects the rising-transition of the fixed code book gain 911 and outputs the rising transition detection information 915. The rising transition detection information 915 is provided to the rising-transition detection information encoding part 953. The rising-transition detection information encoding part 953 encodes the rising transition detection information 915 and outputs the encoded rising transition detection information 954 when the transform coded code words 952 are selected by the selector 951 as the output of the encoder 930. Then, the encoder 930 outputs both the encoded code sequence 955 selected by the selector 951 and the encoded rising transition detection information 954 as the output of the encoder 930. Therefore, the encoder 930 supplies the encoded rising transition detection information 954.

Figure 12:
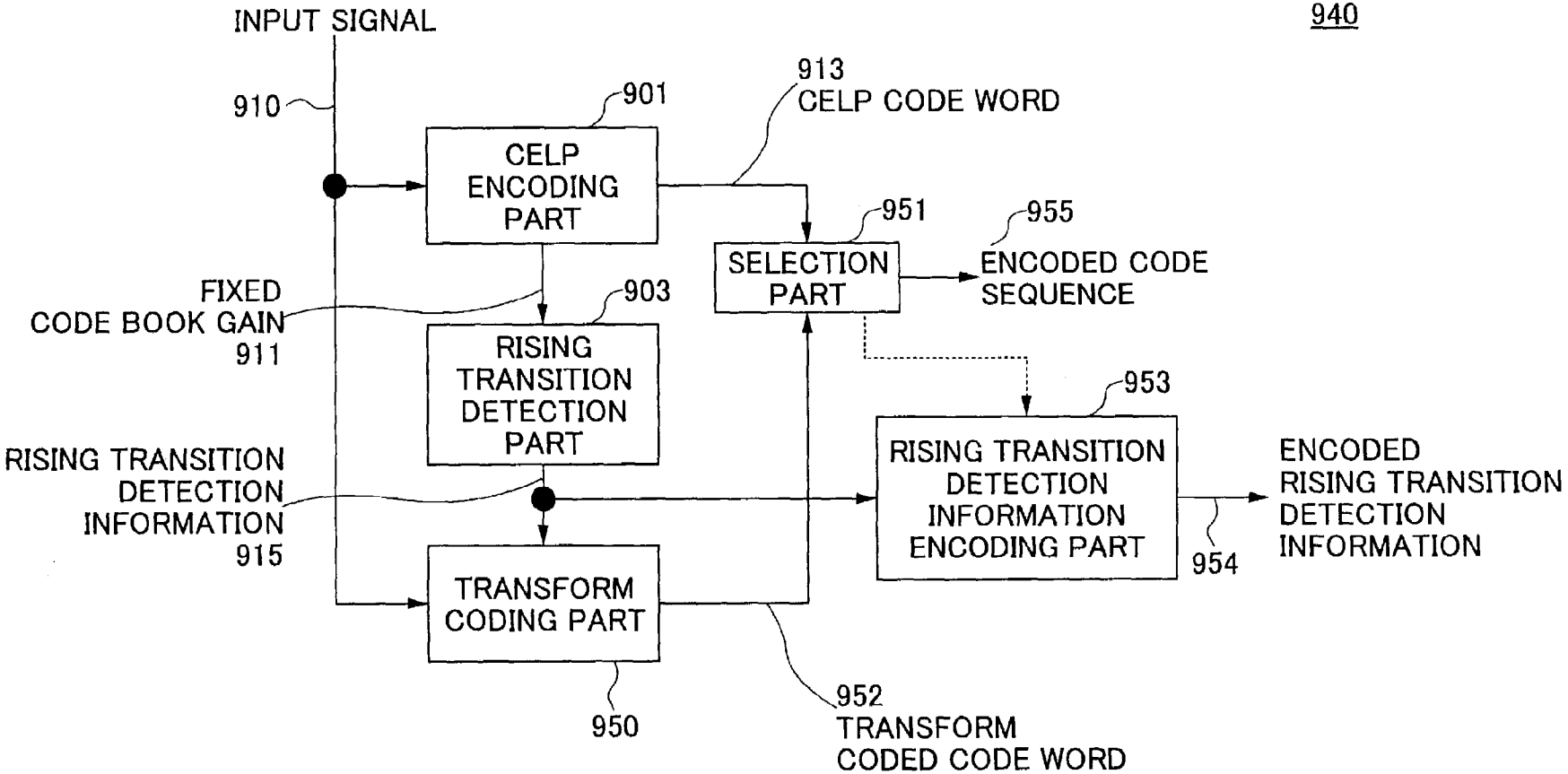
FIG. 12 shows a block diagram of an encoder according to the fifth embodiment of the present invention.

Next, the fifth embodiment of the present invention will be explained. FIG. 12 shows a block diagram of an encoder 940 according to the fifth embodiment of the present invention, in which the input signal is encoded using the CELP encoding method and another encoding method, such as, for example, the transform coding method, and either a code sequence encoded using the CELP encoding method or a code sequence encoded using the other encoding method is supplied as an output of the encoder.

The encoder 940 has the CELP encoding part 901, the rising transition detection part 903, a transform coding part 950, a selection part 951 and a rising-transition detection information encoding part 953.

In FIG. 12, the input signal 910 is encoded by the CELP encoding part 901 and the CELP code words 913 are output and at the same time, the fixed code book gain 911 is supplied to the rising transition detection part 903. On the other hand, the input signal 910 is also encoded by the transform coding part 950 and the transform coded code words 952 are output. At the same time, the same as described in the first embodiment, the rising transition detection part 903 observes the time variation of the fixed code book gain 911 and detects the rising-transition of the fixed code book gain 911 and outputs the rising transition detection information 915. Then, the rising transition detection information 915 is provided to both the transform coding part 950 and the rising-transition detection information encoding part 953. The transform coding part 950 encodes the input signal 910 with reference to the rising transition detection information 915. On the other hand, the rising-transition detection information encoding part 953 encodes the rising transition detection information 915 and outputs the encoded rising transition detection information 954 when the transformation encoded code words 952 are selected by the selector 951 as the output of the encoder 940. Then, the encoder 940 outputs both the encoded code sequence 955 selected by the selector 951 and the encoded rising transition detection information 954 as the output of the encoder 940. Therefore, the encoder 940 supplies the encoded rising transition detection information 954.

Next, the other embodiments will be explained below. The following embodiments are embodiments of the rising transition detection part as described in the first embodiment through the fifth embodiment. The relationship among the transform block, the CELP frame and the CELP sub-frame is the same relationship as shown in FIG. 8.

Figure 13:
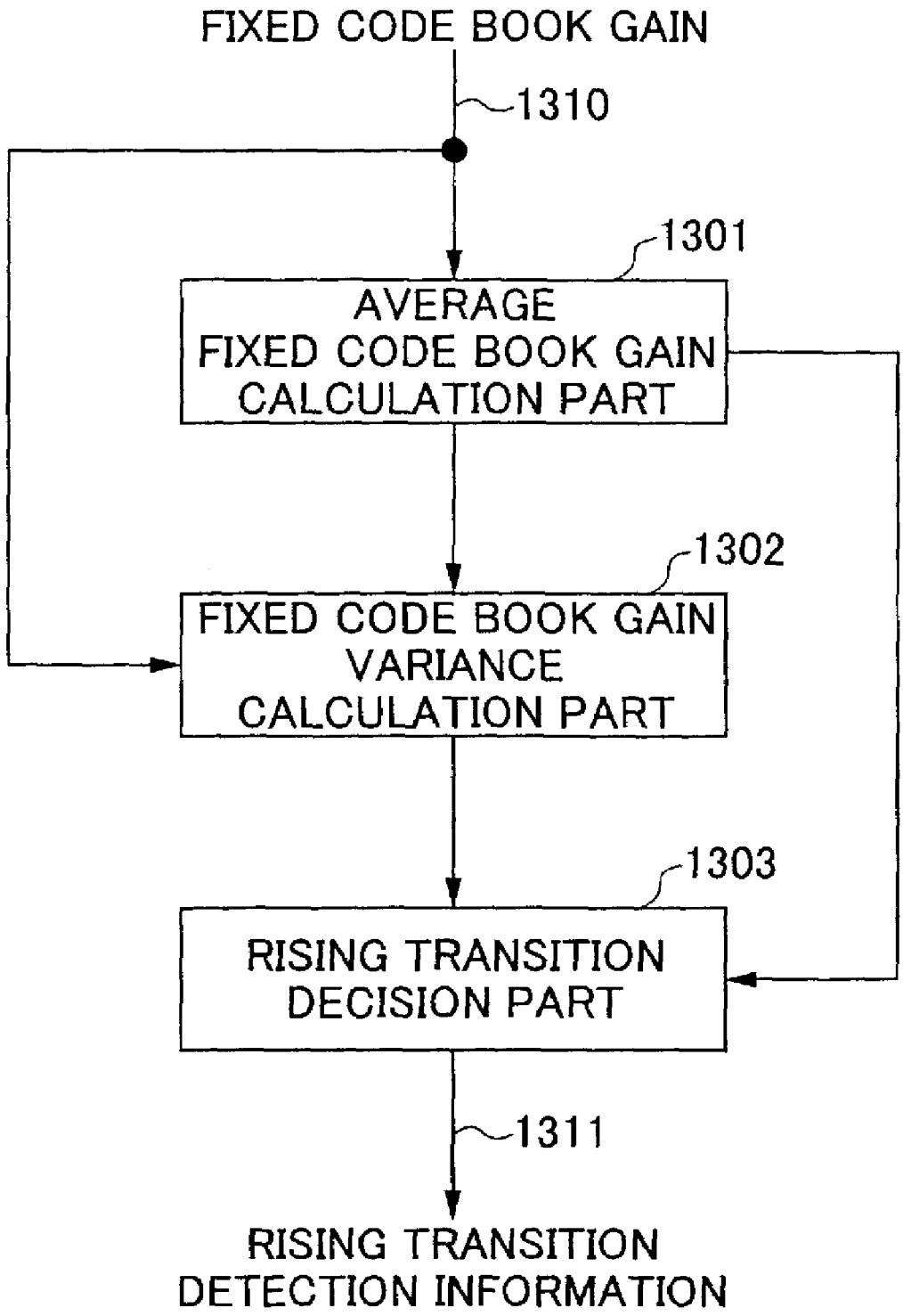
FIG. 13 shows a block diagram of a rising-transition detection part according to the sixth embodiment of the present invention.

First, the sixth embodiment of the present invention will be explained. FIG. 13 shows a block diagram of a rising-transition detection part according to the sixth embodiment of the present invention. The rising-transition detection part as shown in FIG. 13 has an average fixed code book gain calculation part 1301, a fixed code book gain variance calculation part 1302 and a rising-transition decision part 1303.

The average value of the fixed code book gains for one transform block is calculated by the average fixed code book gain calculation part 1301. For example, assuming that the fixed code book gain is calculated for each CELP sub-frame. Therefore, in the case that the input signal is encoded for every CELP frame that consists of N CELP sub-frames (N=4 for the case shown in FIG. 8), because one transform block consists of M CELP frames (M=4 for the case shown in FIG. 8), the average fixed code book gain for k transform blocks is expressed as follow, $$\bar{g}_k^c = \frac{1}{M \cdot N} \sum_{m=0}^{M-1} \sum_{n=0}^{N-1} g_{k,m,n}^c \tag{1}$$

,where $$g_{k,m,n}^c$$

is a fixed code book gain of the n-th CELP sub-frame in the m-th CELP frame of the collection of the CELP frames in the k-th transform block. The variance of the fixed code book gain is calculated by the fixed code book gain variance calculation part 1302 using both the average fixed code book gain and each of the fixed code book gains. The variance of the fixed code book gains in the k-th transform block is expressed as follows.

$$v_k = \frac{1}{MN-1} \sum_{m=0}^{M-1} \sum_{n=0}^{N-1} (g_{k,m,n}^c - \bar{g}_k^c)^2 \tag{2}$$

Then, the rising-transition decision part 1303 determines whether the rising-transition of the fixed code book gain exists or not in the k-th transform block by means of comparing the variance of the fixed code book gain calculated using expression (2) with a predetermined threshold value. Further, it is possible to change the threshold value for every transform block according to the input signal. Then, the rising-transition detection information 1311 is output from the rising-transition decision part 1303.

Figure 14:
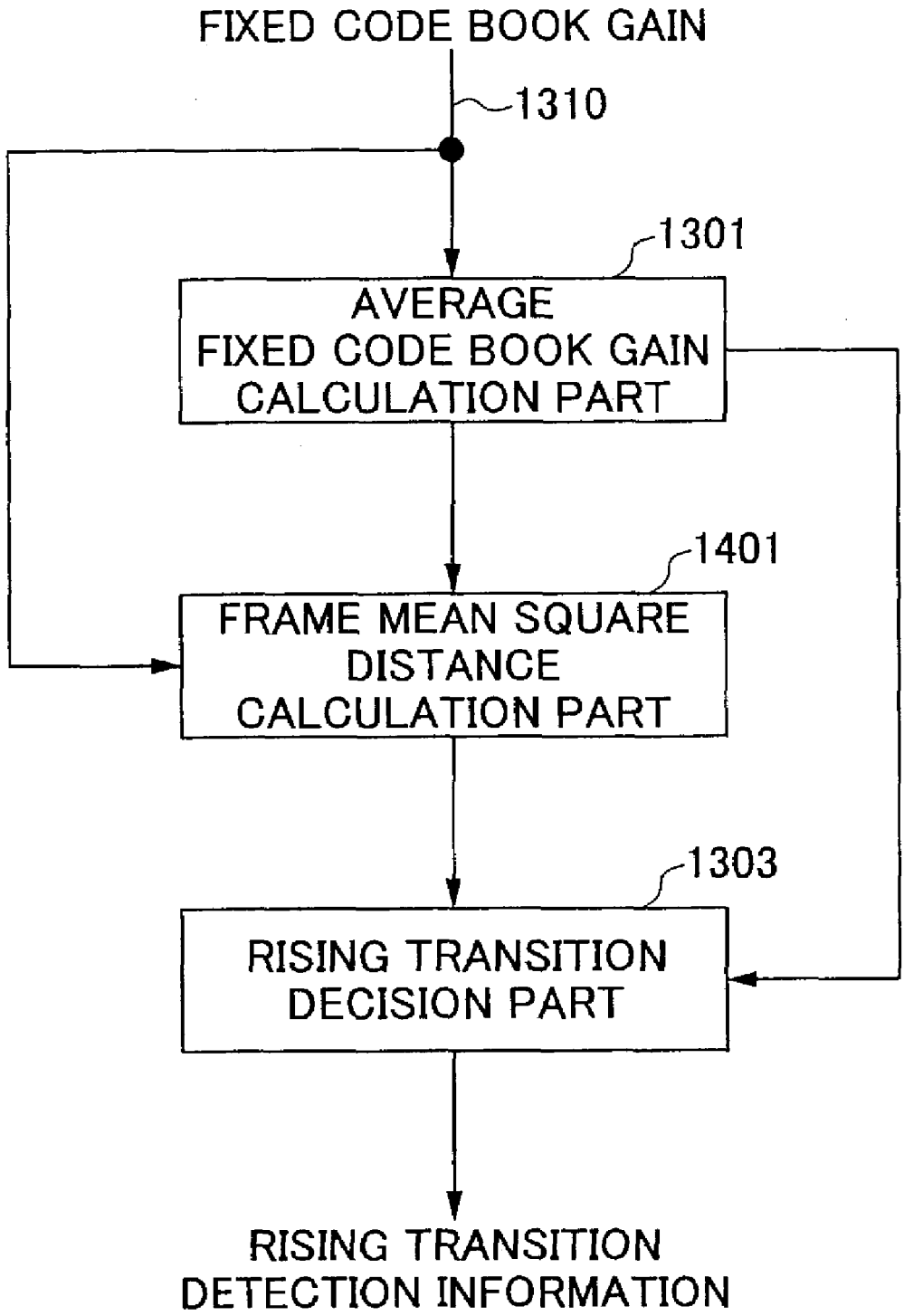
FIG. 14 shows a block diagram of a rising-transition detection part according to the seventh embodiment of the present invention.

Next, the seventh embodiment of the present invention will be explained. FIG. 14 shows a block diagram of a rising-transition detection part according to the seventh embodiment of the present invention. The rising-transition detection part as shown in FIG. 14 has an average fixed code book gain calculation part 1301, a frame mean square distance calculation part 1401 and a rising-transition decision part 1303. In this embodiment, the average fixed code book gain calculation part 1301 performs the same operation as described in the sixth embodiment as shown in FIG. 13. Next, the frame mean square distance calculation part 1401 calculates the frame mean square distance between the average fixed code book gain and the fixed code book gain for each CELP sub-frame, for each CELP frame. The frame mean square distance of m-th CELP frame within the k-th transform block is expressed as follows.

$$s_{k,m}^2 = \frac{1}{N}\sum_{n=0}^{N-1}(g_{k,m,n}^c - \bar{g}_k^c)^2 \quad (3)$$

Then, the rising-transition decision part 1303 determines whether the rising-transition of the fixed code book gain exists or not in the k-th transform block by means of comparing the frame mean square distance calculated using expression (3) with a predetermined threshold value. Further, it is possible to change the threshold value for every transform block according to the input signal. Then, the rising-transition detection information 1311 as detected above is output from the rising-transition decision part 1303.

Figure 15:
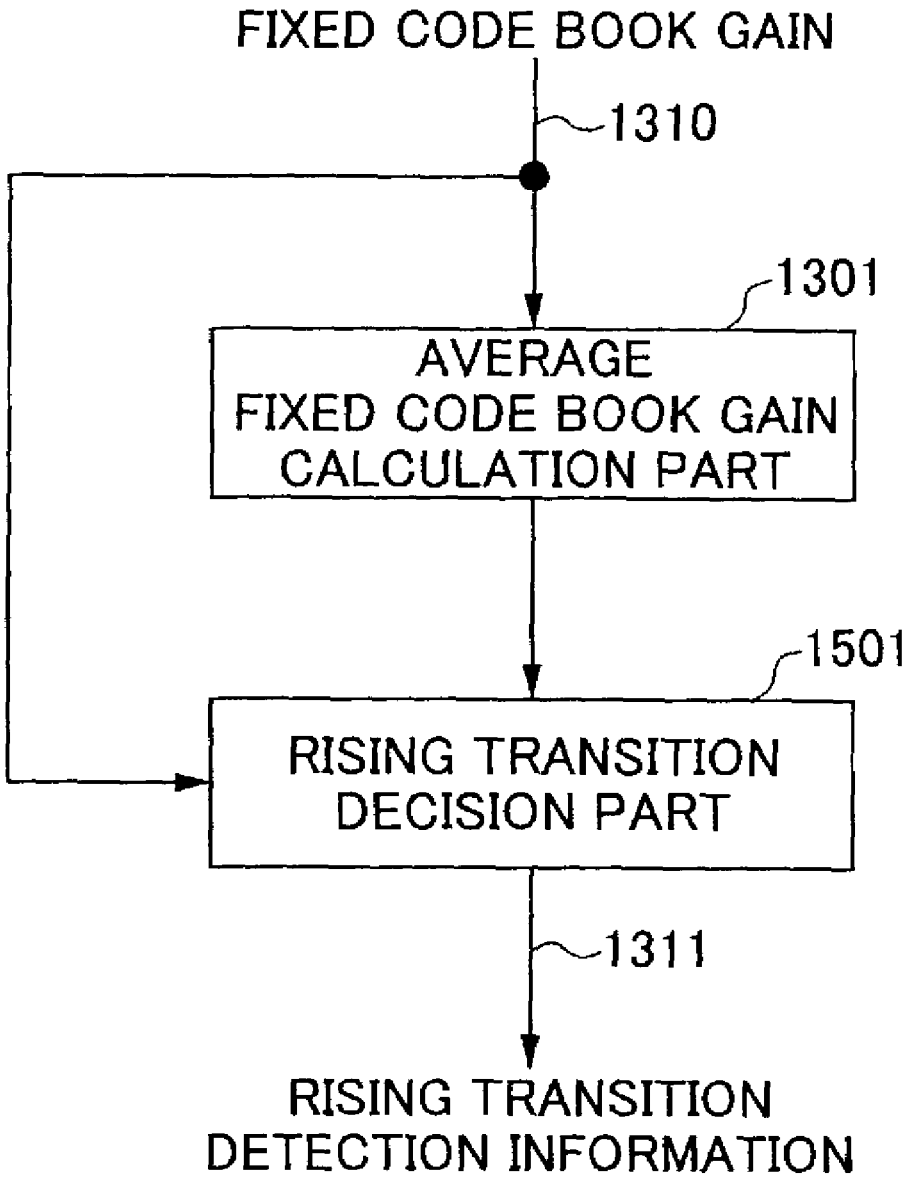
FIG. 15 shows a block diagram of a rising-transition detection part according to the eighth embodiment of the present invention.

Next, the eighth embodiment of the present invention will be explained. FIG. 15 shows a block diagram of a rising-transition detection part according to the eighth embodiment of the present invention. The rising-transition detection part as shown in FIG. 15 has an average fixed code book gain calculation part 1301 and a rising-transition decision part 1501. In this embodiment, the average fixed code book gain calculation part 1301 performs the same operation as described in the sixth embodiment as shown in FIG. 13. Then, the rising-transition decision part 1501 determines whether the rising-transition of the fixed code book gain exists or not by means of comparing the average fixed code book gain or a modified value that is, for example, the average fixed code book gain multiplied by a constant calculated by the average fixed code book gain calculation part 1301, with the fixed code book gain for each CELP sub-frame in the transform block, and outputs the rising-transition detection information 1311.

Figure 16:
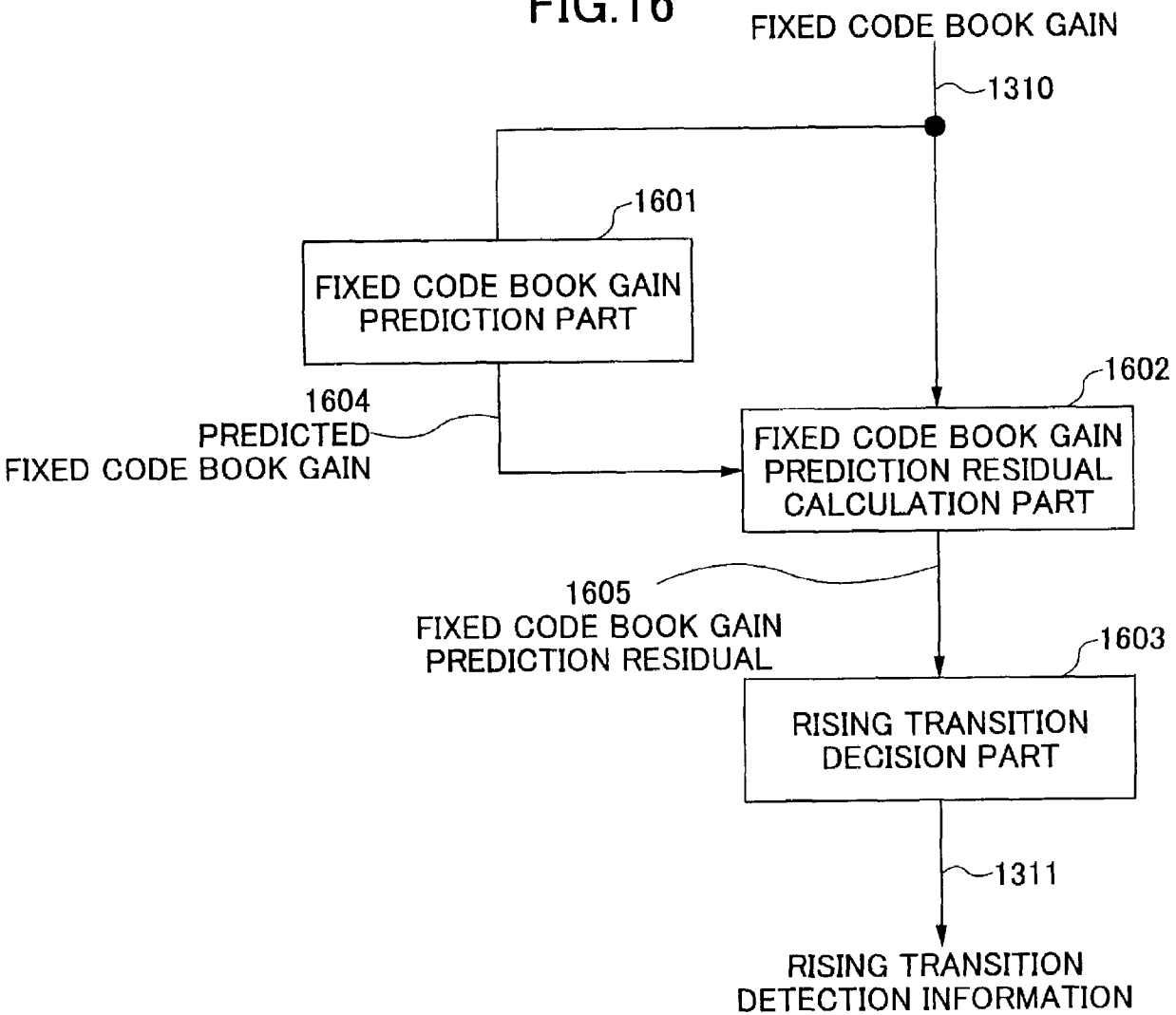
FIG. 16 shows a block diagram of a rising-transition detection part according to the ninth embodiment of the present invention.

Next, the ninth embodiment of the present invention will be explained. FIG. 16 shows a block diagram of a rising-transition detection part according to the ninth embodiment of the present invention. The rising-transition detection part as shown in FIG. 16 has a fixed code book gain prediction part 1601, a fixed code book gain prediction residual detection part 1602 and a rising-transition decision part 1603. The fixed code book gain prediction part 1601 predicts the fixed code book gain of the CELP sub-frame from the fixed code book gain of the past CELP sub-frames and calculates a predicted fixed code book gain 1604. For example, the predicted fixed code book gain 1604 is calculated from an expressions (4) and (5) as follows.

$$\hat{g}_{k,m,n}^c = \sum_{p=1}^{P} a_p g_{k,m,n-1}^c \quad (4)$$

$$\begin{aligned} g_{k,m,-1}^c &= g_{k,m-1,N-1}^c (m \neq 0) \\ &= g_{k-1,M-1,N-1}^c (m = 0) \end{aligned} \quad (5)$$

The fixed code book gain 1310 of the CELP sub-frame is kept in the fixed code book gain prediction part 1601 in order to calculate the predicted fixed code book gain 1604 of the next CELP sub-frame. At the same time, the fixed code book gain 1310 is supplied to the fixed code book gain prediction residual detection part 1602 and then, the fixed code book gain prediction residual detection part 1602 calculates a difference between the fixed code book gain 1310 and the predicted fixed code book gain 1604 to obtain the fixed code book gain prediction residual 1605. Next, the rising-transition decision part 1603 compares the fixed code book gain prediction residual 1605 with a predetermined threshold value and determines whether the rising-transition of the fixed code book gain exists or not and then, outputs the rising-transition detection information 1311.

In the description above, the fixed code book gain is used to describe the embodiments of the present invention. However, it is understood by those who are skilled in the art that it is possible to use the power of the decoded signal instead of the fixed code book gain. In the case that the power of the decoded signal is used instead of the fixed code book gain, examples of methods to determine whether the rising-transition of the power of the input signal exists or not are as follows. For example, it is possible to use a method in which an average power of the decoded signals for every CELP sub-frame is calculated and then, it is decided whether the rising-transition of the power of the input signal exists or not by comparing the time variation of the average power with a predetermined threshold value. Furthermore, it is possible to use a method in which a moving average is calculated using a predetermined number of samples and the time variation of the moving average is observed and then, determining whether the rising-transition of the amplitude of the input signal exists or not. Furthermore, in the case that the encoder performs the process, it is possible to send the rising-transition detection information, which is supplied to the second encoding part, to a decoding side as a part of the encoded sequence.

In the description above, embodiments that process speech or audio signals are described. However, it is understood that the present invention is applied to other apparatuses or methods that process other digital signals having characteristics similar to speech or audio signals.

It is possible to provide the encoding or the decoding apparatuses and methods, which use the CELP encoding method and another encoding method, such as, for example, the scalable encoding method that uses the CELP encoding method as the core layer encoding method and other encoding methods as the enhancement layer encoding methods, that observe the time variation of the fixed code book gain and detect the rising-transition of the amplitude of the input signal and notify the enhancement layers.

In the decoding apparatus, the time variation of the decoded signal may be time variation of power level of the decoded signal.

In the decoding apparatus, the input signal may be one of a speech signal and an audio signal.

In the encoding apparatus, the time variation of the local decoded signal may be time variation of power level of the decoded signal.

In the encoding apparatus, the input signal is one of a speech signal and an audio signal.

In the decoding method, the gain of excitation vectors may be one of a gain of a fixed code book and a parameter of the gain of a fixed code book.

In the decoding method, the time variation of the decoded signal may be time variation of power level of the decoded signal.

In the decoding method, the input signal is one of a speech signal and an audio signal.

In the encoding method, the gain of excitation vectors is one of a gain of a fixed code book and a parameter of the gain of a fixed code book.

In the encoding method, the time variation of the local decoded signal may be time variation of power level of the decoded signal.

In the encoding method, the input signal is one of a speech signal and an audio signal.

The present invention is not limited to the specifically disclosed embodiments, and variations and modifications may be made without departing from the scope of the present invention.

The present application is based on Japanese priority application No.2002-033154 filed on Feb. 8, 2002, the entire contents of which are hereby incorporated by reference.

What is claimed is:

1. A decoding apparatus comprising:

a first decoding part for decoding a code word obtained by encoding an input signal using a Code-Excited Linear Prediction encoding method;

a second decoding part for decoding a code word obtained by encoding a signal with an encoding method other than said Code-Excited Linear Prediction encoding method; and a rising-transition detection and notification part comprising:

a detection part that detects the existence of a rising-transition of amplitude of said input signal based on time variation of a gain of excitation vectors obtained by said first decoding part; and a notification part that notifies said second decoding part that said rising-transition of said amplitude exists, wherein said second decoding part is configured to output a signal obtained by decoding an enhancement layer code word based on an output of said notification part.

2. The decoding apparatus as claimed in claim 1, wherein said gain of excitation vectors is one of a gain of a fixed code book and a parameter of said gain of a fixed code book.

3. The decoding apparatus as claimed in claim 1, wherein said second decoding part decodes said code word obtained by encoding a difference between said input signal and a decoded signal decoded by said first decoding part.

4. The decoding apparatus as claimed in claim 1, wherein said second decoding part decodes said code word obtained by encoding a difference between a linear prediction residual signal of said input signal and an excitation vector of a linear prediction synthesis filter decoded by said first decoding part.

5. A decoding apparatus comprising:

a first decoding part for decoding a code word obtained by encoding an input signal using a Code-Excited Linear Prediction encoding method;

a second decoding part for decoding a code word obtained by encoding a signal with an encoding method other than said Code-Excited Linear Prediction encoding method; and a rising-transition detection and notification part comprising:

a detection part that detects the existence of a rising-transition of amplitude of said input signal based on time variation of a decoded signal waveform obtained by said first decoding part; and a notification part that notifies said second decoding part that said rising-transition of said amplitude exists, wherein said second decoding part is configured to output a signal obtained by decoding an enhancement layer code word based on an output of said notification part.

6. The decoding apparatus as claimed in claim 5, wherein said second decoding part decodes said code word obtained by encoding a difference between said input signal and a decoded signal decoded by said first decoding part.

7. The decoding apparatus as claimed in claim 5, wherein said second decoding part decodes said code word obtained by encoding a difference between a linear prediction residual signal of said input signal and an excitation vector of a linear prediction synthesis filter decoded by said first decoding part.

8. An encoding apparatus comprising: a first encoding part for encoding an input signal to a code word using a Code-Excited Linear Prediction encoding method;

a second encoding part for encoding a signal to a code word using an encoding method other than said Code-Excited Linear Prediction encoding method; and a rising-transition detection and notification part comprising:

a detection part that detects the existence of a rising-transition of amplitude of said input signal based on time variation of a gain of excitation vectors obtained by said first encoding part; and a notification part that notifies said second encoding part that said rising-transition of said amplitude exists, wherein said second encoding part is configured to output an encoded enhancement layer code word based on an output of said notification part.

9. The encoding apparatus as claimed in claim 8, wherein said gain of excitation vectors is one of a gain of a fixed code book and a parameter of said gain of a fixed code book.

10. The encoding apparatus as claimed in claim 8, wherein said second encoding part encodes a difference between said input signal and a decoded signal obtained by decoding an encoded signal encoded by said first encoding part.

11. The encoding apparatus as claimed in claim 8, wherein said encoding apparatus outputs one of a code word encoded by said first encoding part and a code word encoded by said second encoding part.

12. The encoding apparatus as claimed in claim 8, wherein said second encoding part encodes a difference between a linear prediction residual signal of said input signal and a decoded excitation vector of a linear prediction synthesis filter obtained by decoding an excitation vector of said linear prediction synthesis filter encoded by said first encoding part.

13. An encoding apparatus comprising:

a first encoding part for encoding an input signal to a code word using a Code-Excited Linear Prediction encoding method;

a second encoding part for encoding a signal to a code word using an encoding method other than said Code-Excited Linear Prediction encoding method; and a rising-transition detection and notification part comprising:

a detection part that detects the existence of a rising-transition of amplitude of said input signal based on time variation of a gain of excitation vectors obtained by said first encoding part; and a notification part that notifies a decoding side that said rising-transition of said amplitude exists as a part of encoded information, wherein said second encoding part is configured to output an encoded enhancement layer code word based on an output of said notification part.

14. The encoding apparatus as claimed in claim 13, wherein said gain of excitation vectors is one of a gain of a fixed code book and a parameter of said gain of a fixed code book.

15. The encoding apparatus as claimed in claim 13, wherein said second encoding part encodes a difference between said input signal and a decoded signal obtained by decoding an encoded signal encoded by said first encoding part.

16. The encoding apparatus as claimed in claim 13, wherein said encoding apparatus outputs one of a code word encoded by said first encoding part and a code word encoded by said second encoding part.

17. The encoding apparatus as claimed in claim 13, wherein said second encoding part encodes a difference between a linear prediction residual signal of said input signal and a decoded excitation vector of a linear prediction synthesis filter obtained by decoding an excitation vector of said linear prediction synthesis filter encoded by said first encoding part.

18. An encoding apparatus comprising:

a first encoding part for encoding an input signal to a code word using a Code-Excited Linear Prediction encoding method;

a second encoding part for encoding a signal to a code word using an encoding method other than said Code-Excited Linear Prediction encoding method; and a rising-transition detection and notification part comprising:

a detection part that detects the existence of a rising-transition of amplitude of said input signal based on time variation of a local decoded signal obtained by said first encoding part; and a notification part that notifies said second encoding part that said rising-transition of said amplitude exists, wherein said second encoding part is configured to output an encoded enhancement layer code word based on an output of said notification part.

19. The encoding apparatus as claimed in claim 18, wherein said second encoding part encodes a difference between said input signal and a decoded signal obtained by decoding an encoded signal encoded by said first encoding part.

20. The encoding apparatus as claimed in claim 18, wherein said encoding apparatus outputs one of a code word encoded by said first encoding part and a code word encoded by said second encoding part.

21. The encoding apparatus as claimed in claim 18, wherein said second encoding part encodes a difference between a linear prediction residual signal of said input signal and a decoded excitation vector of a linear prediction synthesis filter obtained by decoding an excitation vector of said linear prediction synthesis filter encoded by said first encoding part.

22. An encoding apparatus comprising:

a first encoding part for encoding an input signal to a code word using a Code-Excited Linear Prediction encoding method;

a second encoding part for encoding a signal to a code word using an encoding method other than said Code-Excited Linear Prediction encoding method; and a rising-transition detection and notification part comprising:

a detection part that detects the existence of a rising-transition of amplitude of said input signal based on time variation of a local decoded signal obtained by said first encoding part; and a notification part that notifies a decoding side that said rising-transition of said amplitude exists as a part of encoded information, wherein said second encoding part is configured to output an encoded enhancement layer code word based on an output of said notification part.

23. The encoding apparatus as claimed in claim 22, wherein said second encoding part encodes a difference between said input signal and a decoded signal obtained by decoding an encoded signal encoded by said first encoding part.

24. The encoding apparatus as claimed in claim 22, wherein said encoding apparatus outputs one of a code word encoded by said first encoding part and a code word encoded by said second encoding part.

25. The encoding apparatus as claimed in claim 22, wherein said second encoding part encodes a difference between a linear prediction residual signal of said input signal and a decoded excitation vector of a linear prediction synthesis filter obtained by decoding an excitation vector of said linear prediction synthesis filter encoded by said first encoding part.

26. A decoding method comprising:

a first decoding step for decoding a code word obtained by encoding an input signal using a Code-Excited Linear Prediction encoding method;

a second decoding step for decoding a code word obtained by encoding a signal with an encoding method other than said Code-Excited Linear Prediction encoding method; and a rising-transition detection and notification step comprising:

a detection sub-step that detects the existence of a rising-transition of amplitude of said input signal based on time variation of a gain of excitation vectors obtained by said first decoding step; and a notification sub-step that notifies said second decoding step that said rising-transition of said amplitude exists, wherein said second decoding step further comprises outputting a signal obtained by decoding an enhancement layer code word based on an output of said notification sub-step.

27. The decoding method as claimed in claim 26, wherein said second decoding step decodes said code word obtained by encoding a difference between said input signal and a decoded signal decoded by said first decoding step.

28. The decoding method as claimed in claim 26, wherein said second decoding step decodes said code word obtained by encoding a difference between a linear prediction residual signal of said input signal and an excitation vector of a linear prediction synthesis filter decoded by said first decoding step.

29. A decoding method comprising:

a first decoding step for decoding a code word obtained by encoding an input signal using a Code-Excited Linear Prediction encoding method;

a second decoding step for decoding a code word obtained by encoding a signal with an encoding method other than said Code-Excited Linear Prediction encoding method; and a rising-transition detection and notification step comprising:

a detection sub-step that detects the existence of a rising-transition of amplitude of said input signal based on time variation of a decoded signal waveform obtained by said first decoding step; and a notification sub-step that notifies said second decoding step that said rising-transition of said amplitude exists, wherein said second decoding step further comprises outputting a signal obtained by decoding an enhancement layer code word based on an output of said notification sub-step.

30. The decoding method as claimed in claim 29, wherein said second decoding step decodes said code word obtained by encoding a difference between said input signal and a decoded signal decoded by said first decoding step.

31. The decoding method as claimed in claim 29, wherein said second decoding step decodes said code word obtained by encoding a difference between a linear prediction residual signal of said input signal and an excitation vector of a linear prediction synthesis filter decoded by said first decoding step.

32. An encoding method comprising:

a first encoding step for encoding an input signal to a code word using a Code-Excited Linear Prediction encoding method;

a second encoding step for encoding a signal to a code word using an encoding method other than said Code-Excited Linear Prediction encoding method; and a rising-transition detection and notification step comprising:

a detection sub-step that detects the existence of a rising-transition of amplitude of said input signal based on time variation of a gain of excitation vectors obtained by said first encoding step; and a notification sub-step that notifies said second encoding step that said rising-transition of said amplitude exists, wherein said second encoding step comprises outputting an encoded enhancement layer code word based on an output of said notification sub-step.

33. The encoding method as claimed in claim 32, wherein said second encoding step encodes a difference between said input signal and a decoded signal obtained by decoding an encoded signal encoded by said first encoding step.

34. The encoding method as claimed in claim 32, wherein said encoding method outputs one of a code word encoded by said first encoding step and a code word encoded by said second encoding step.

35. The encoding method as claimed in claim 32, wherein said second encoding step encodes a difference between a linear prediction residual signal of said input signal and a decoded excitation vector of a linear prediction synthesis filter obtained by decoding an excitation vector of said linear prediction synthesis filter encoded by said first encoding step.

36. An encoding method comprising:

a first encoding step for encoding an input signal to a code word using a Code-Excited Linear Prediction encoding method;

a second encoding step for encoding a signal to a code word using an encoding method other than said Code-Excited Linear Prediction encoding method; and a rising-transition detection and notification step comprising:

a detection sub-step that detects the existence of a rising-transition of amplitude of said input signal based on time variation of a gain of excitation vectors obtained by said first encoding step; and a notification sub-step that notifies a decoding side that said rising-transition of said amplitude exists as a part of encoded information, wherein said second encoding step comprises outputting an encoded enhancement layer code word based on an output of said notification sub-step.

37. The encoding method as claimed in claim 36, wherein said second encoding step encodes a difference between said input signal and a decoded signal obtained by decoding an encoded signal encoded by said first encoding step.

38. The encoding method as claimed in claim 36, wherein said encoding method outputs one of a code word encoded by said first encoding step and a code word encoded by said second encoding step.

39. The encoding method as claimed in claim 36, wherein said second encoding step encodes a difference between a linear prediction residual signal of said input signal and a decoded excitation vector of a linear prediction synthesis filter obtained by decoding an excitation vector of said linear prediction synthesis filter encoded by said first encoding step.

40. An encoding method comprising:

a first encoding step for encoding an input signal to a code word using a Code-Excited Linear Prediction encoding method;

a second encoding step for encoding a signal to a code word using an encoding method other than said Code-Excited Linear Prediction encoding method; and a rising-transition detection and notification step comprising:

a detection sub-step that detects the existence of a rising-transition of amplitude of said input signal based on time variation of a local decoded signal obtained by said first encoding step; and a notification sub-step that notifies said second encoding step that said rising-transition of said amplitude exists, wherein said second encoding step comprises outputting an encoded enhancement layer code word based on an output of said notification sub-step.

41. The encoding method as claimed in claim 40, wherein said second encoding step encodes a difference between said input signal and a decoded signal obtained by decoding an encoded signal encoded by said first encoding step.

42. The encoding method as claimed in claim 40, wherein said encoding method outputs one of a code word encoded by said first encoding step and a code word encoded by said second encoding step.

43. The encoding method as claimed in claim 40, wherein said second encoding step encodes a difference between a linear prediction residual signal of said input signal and a decoded excitation vector of a linear prediction synthesis filter obtained by decoding an excitation vector of said linear prediction synthesis filter encoded by said first encoding step.

44. An encoding method comprising:

a first encoding step for encoding an input signal to a code word using a Code-Excited Linear Prediction encoding method;

a second encoding step for encoding a signal to a code word using an encoding method other than said Code-Excited Linear Prediction encoding method; and a rising-transition detection and notification step comprising:

a detection sub-step that detects the existence of a rising-transition of amplitude of said input signal based on time variation of a local decoded signal obtained by said first encoding step; and a notification sub-step that notifies a decoding side that said rising-transition of said amplitude exists as a part of encoded information, wherein said second encoding step comprises outputting an encoded enhancement layer code word based on an output of said notification sub-step.

45. The encoding method as claimed in claim 44, wherein said second encoding step encodes a difference between said input signal and a decoded signal obtained by decoding an encoded signal encoded by said first encoding step.

46. The encoding method as claimed in claim 44, wherein said encoding method outputs one of a code word encoded by said first encoding step and a code word encoded by said second encoding step.

47. The encoding method as claimed in claim 44, wherein said second encoding step encodes a difference between a linear prediction residual signal of said input signal and a decoded excitation vector of a linear prediction synthesis filter obtained by decoding an excitation vector of said linear prediction synthesis filter encoded by said first encoding step.

* * * * *